US007758374B2

(12) United States Patent
Yu et al.

(10) Patent No.: US 7,758,374 B2
(45) Date of Patent: Jul. 20, 2010

(54) CABLE CONNECTOR ASSEMBLY HAVING WIRE MANAGEMENT MEMBERS WITH LOW PROFILE

(75) Inventors: Ya-Fei Yu, ShenZhen (CN); Xian-Kui Shi, ShenZhen (CN); Chung-Yen Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/322,499

(22) Filed: Feb. 2, 2009

(65) Prior Publication Data

US 2009/0197459 A1 Aug. 6, 2009

(30) Foreign Application Priority Data

Feb. 1, 2008 (CN) ..... 2008 1 0018405

(51) Int. Cl.
*H01R 12/24* (2006.01)

(52) U.S. Cl. ..... 439/493

(58) Field of Classification Search ..... 439/493, 439/494, 497, 607.01, 607.54, 607.55, 607.56, 439/607.46

See application file for complete search history.

(56) References Cited

U.S. PATENT DOCUMENTS 4,602,830 A * 7/1986 Lockard ..... 439/108
5,085,595 A * 2/1992 Koegel et al. ..... 439/494
6,007,385 A 12/1999 Wu
6,039,611 A * 3/2000 Yang ..... 439/701
6,106,338 A 8/2000 Wu
6,582,252 B1 * 6/2003 Lin ..... 439/607.46
6,585,528 B1 * 7/2003 Lin et al. ..... 439/76.1
6,869,308 B2 3/2005 Wu
7,090,534 B2 8/2006 Wu
7,147,512 B2 * 12/2006 Wu ..... 439/607.05
7,331,824 B2 2/2008 Lin
7,462,071 B1 * 12/2008 Wu ..... 439/607.05
7,497,724 B1 * 3/2009 Fong et al. ..... 439/497
2004/0067680 A1 * 4/2004 Wu ..... 439/497
2004/0157490 A1 * 8/2004 Wu ..... 439/607
2004/0157492 A1 * 8/2004 Wu et al. ..... 439/607
2006/0270271 A1 * 11/2006 Moriyama et al. ..... 439/499
2008/0132116 A1 * 6/2008 Wu ..... 439/609

FOREIGN PATENT DOCUMENTS

CN 2711949 Y 7/2005

* cited by examiner

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

A cable connector assembly (100) includes two rows of conductive terminals (2) held in an insulative housing (1), a plurality of wires (60) electrically connecting with the corresponding conductive terminals, and upper and lower spacers (41, 42) behind the insulative housing to arrange the wires in order. A plurality of first partitions (411) protrude upwards from top surface of the upper spacer to form a plurality of first slots (410) for receiving a group of the wires, and a plurality of second partitions (421) protrude downwards from bottom surface of the lower spacer to form a plurality of second slots (420) for receiving another group of the wires.

3 Claims, 5 Drawing Sheets

CABLE CONNECTOR ASSEMBLY HAVING WIRE MANAGEMENT MEMBERS WITH LOW PROFILE

BACKGROUND OF THE INVENTION

1. Field of the Invention

This invention generally relates to a cable connector assembly with plural rows of wires, and more particularly, to a cable connector assembly having a wire management member with a low profile.

2. Description of the Prior Art

Developed by Sony, Hitachi, Thomson (RCA), Philips, Matsushita (Panasonic), Toshiba and Silicon Image, the High-Definition Multimedia Interface (HDMI) has emerged as the connection standard for HDTV and the consumer electronics market. HDMI is the first and only digital interface to combine uncompressed high-definition video, multi-channel audio and intelligent format and command data in a single digital interface.

According to the connection standard of HDMI, an HDMI cable assembly generally comprises an insulative housing having a plurality of passages, a plurality of contacts disposed in the housing, a shielding shell surrounding the housing, a cable having a plurality of conductors terminated to the contacts and an insulated protecting cover molded over joint portions of the cable and the contacts. In addition, a spacer is provided to seal up rear openings of the passages during molding of the protecting cover. Generally, the spacer defines a plurality of though holes permitting tail portions of the contacts passing through to solder with the conductors of the cable. For achieving desired soldering effect, the tail portions and the conductors are supported by a rearwardly extending supporting plate.

BRIEF SUMMARY OF THE INVENTION

It is an object of the present invention to provide a cable connector assembly having a wire management member with a low profile.

In order to attain the object above, a cable connector assembly according to the present invention comprises two rows of conductive terminals held in an insulative housing, a plurality of wires electrically connecting with the corresponding conductive terminals, and upper and lower spacers behind the insulative housing to arrange the wires in order. A plurality of first partitions protrude upwards from top surface of the upper spacer to form a plurality of first slots for receiving a group of the wires, and a plurality of second partitions protrude downwards from bottom surface of the lower spacer to form a plurality of second slots for receiving another group of the wires.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
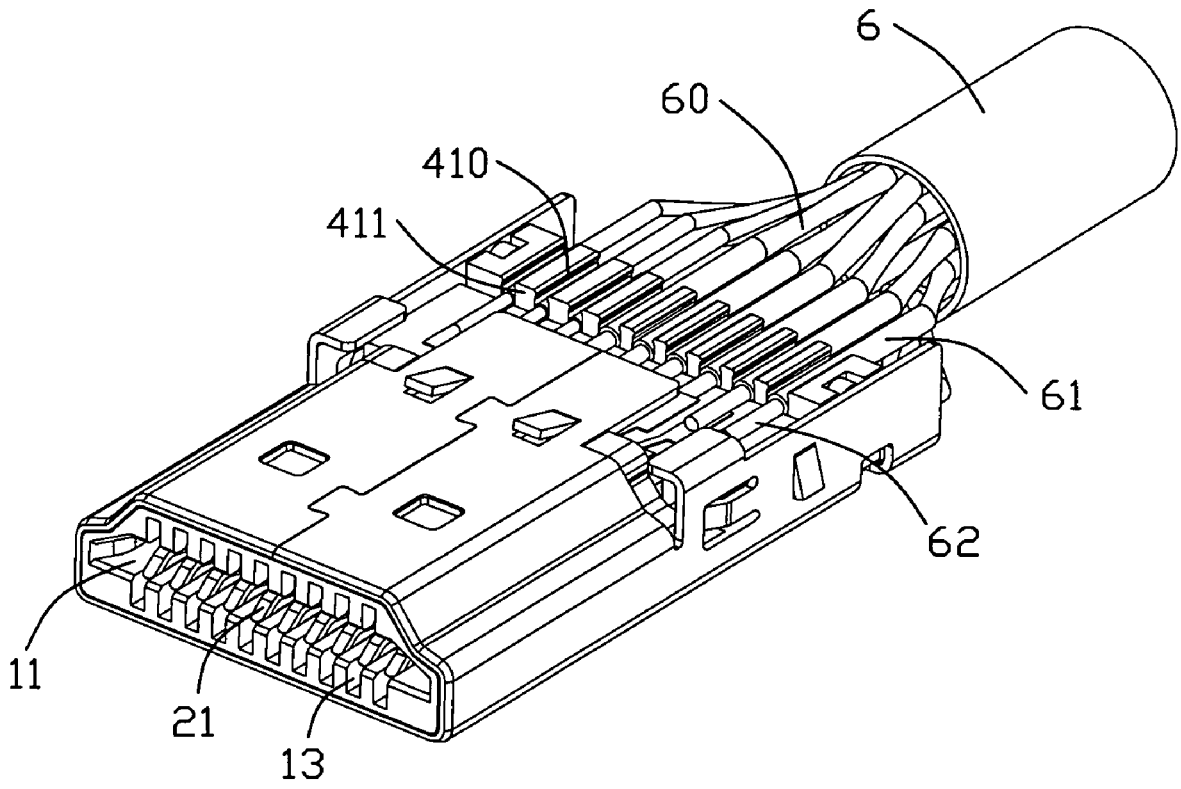
FIG. 1 is an assembled, perspective view of a cable connector assembly in accordance with the present invention.
Figure 2:
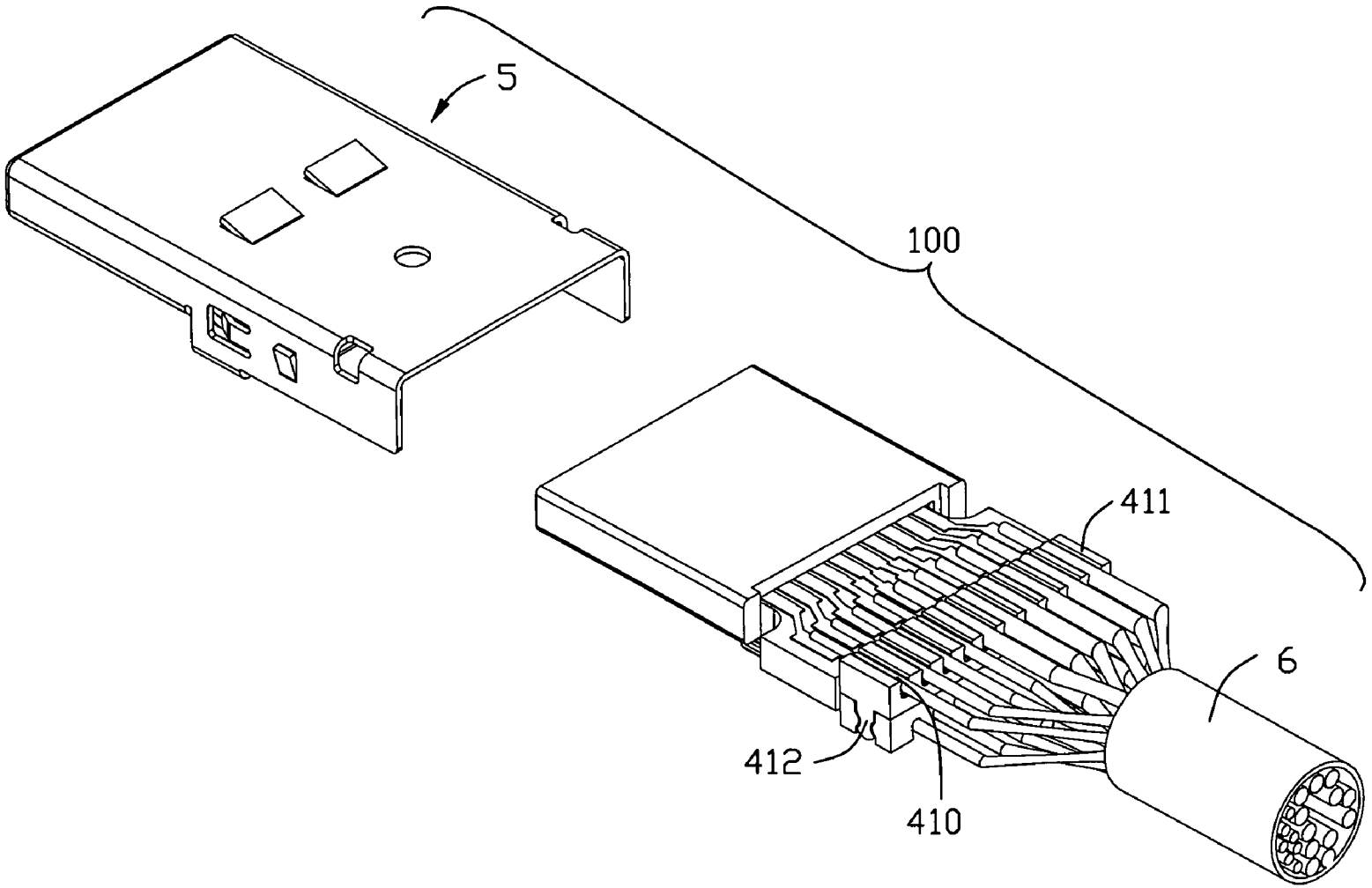
FIG. 2 is a partially assembled view of the cable connector assembly shown in FIG. 1.
Figure 3:
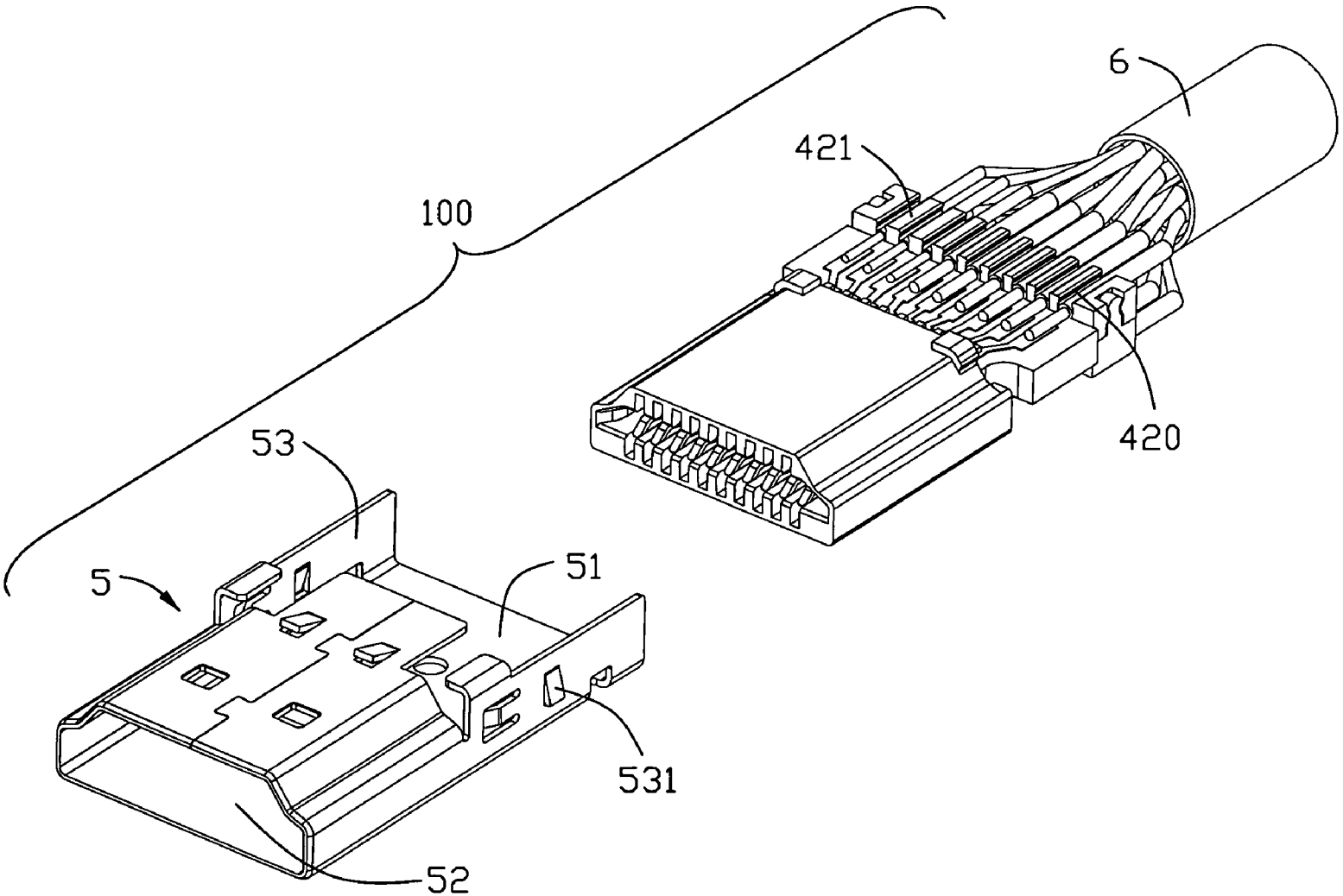
FIG. 3 is a view similar to FIG. 2, but viewed from another aspect.
Figure 4:
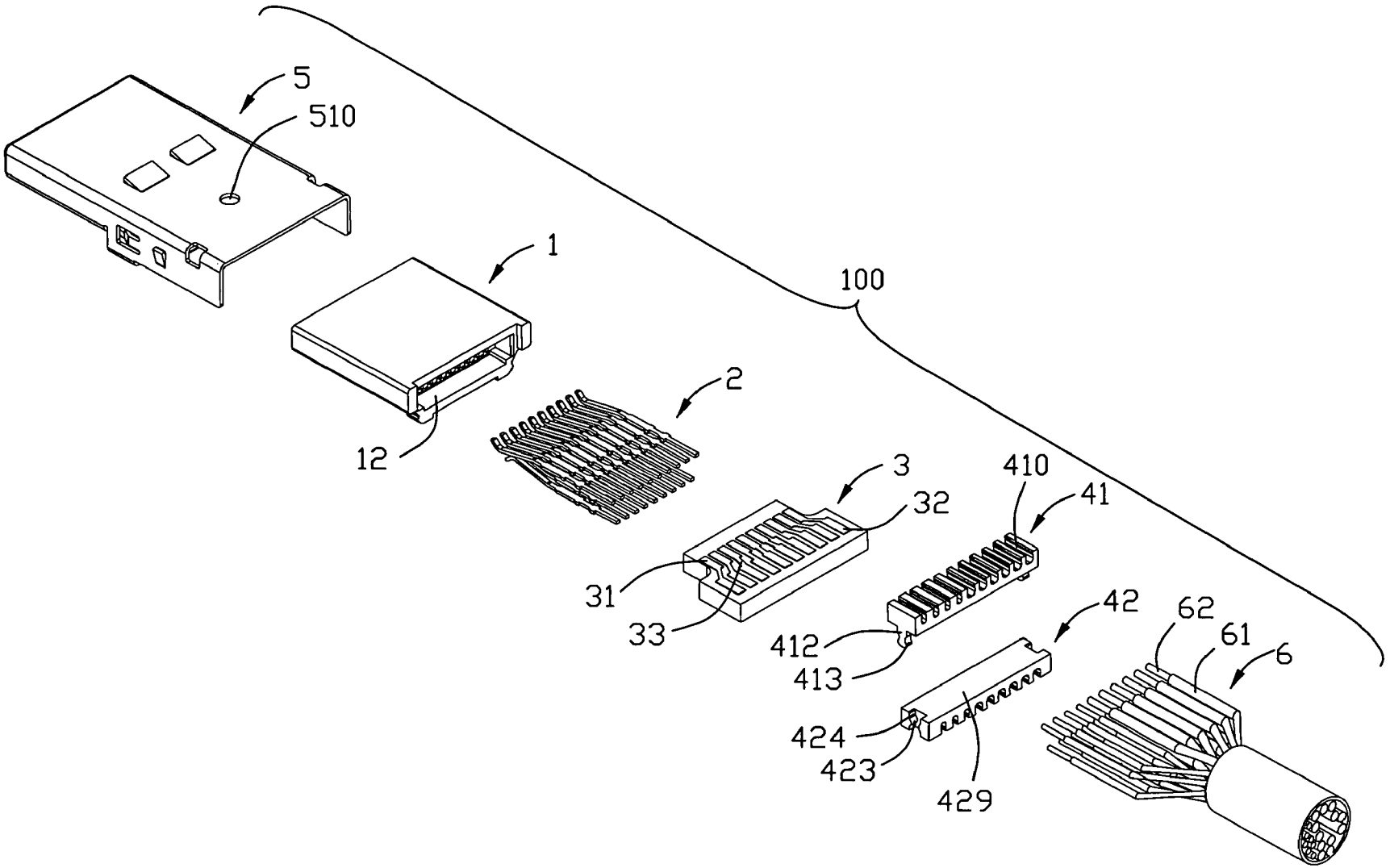
FIG. 4 is an exploded, perspective view of the cable connector assembly shown in FIG. 1.
Figure 5:
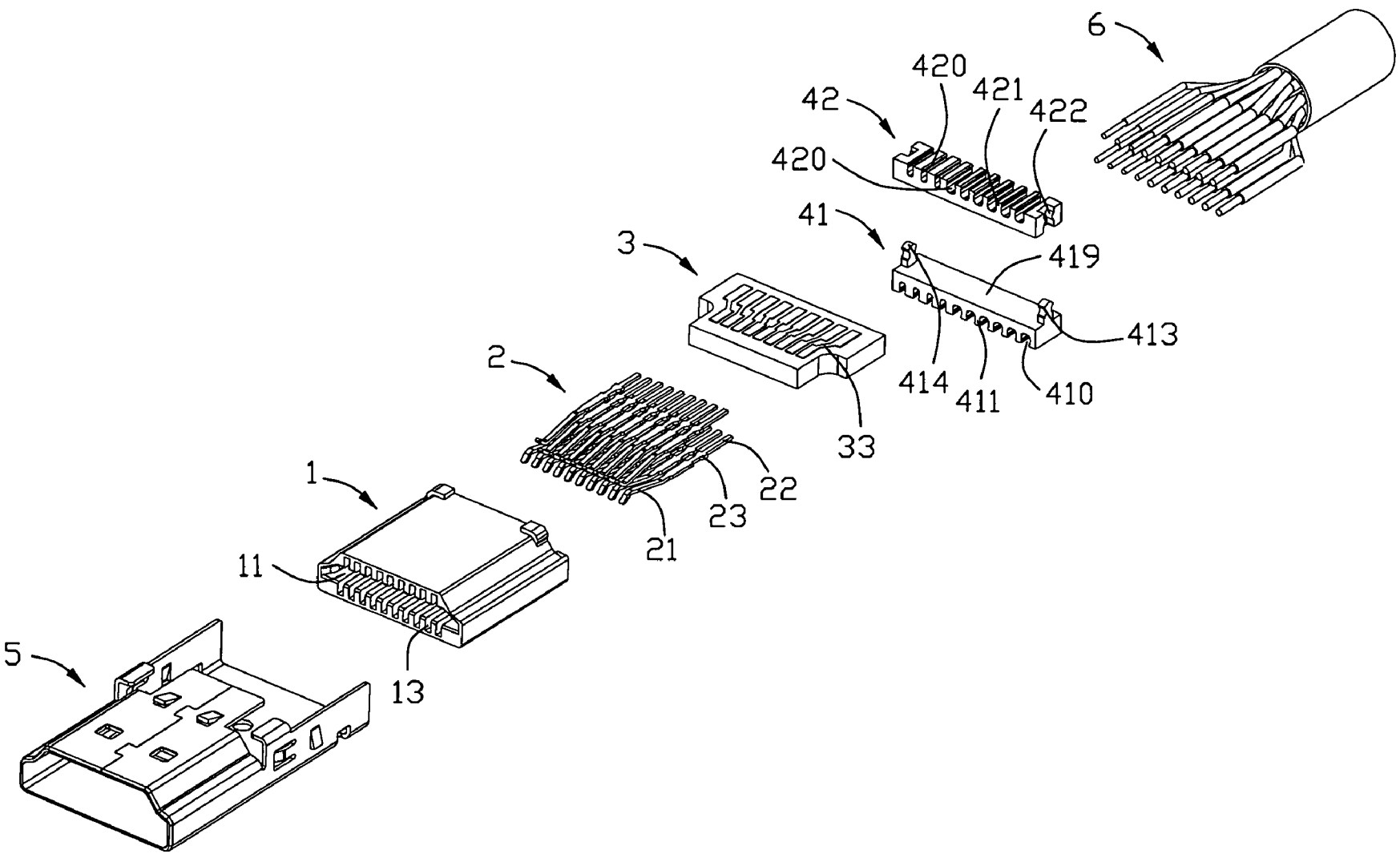
FIG. 5 is a view similar to FIG. 4, but viewed from another aspect.

Please referring to FIGS. 1-5, a cable connector assembly 100 according to a preferred embodiment of the present invention comprises an insulative housing 1, a plurality of conductive terminals 2 disposed in the housing 1, a PCB (Printed Circuit Board) 3 mounted behind the housing 1 and connected with the terminals 2, a cable 6 with a plurality of wires 60 thereof, a wire management member for arranging the wires 60, and a metal shell 5 shielding the housing 1 and the PCB 3.

The housing 1 comprises a trapezoid space 11 formed by four walls in the front for receiving a complementary connector (not shown), and a rectangular space 12 at the rear end for receiving the PCB 3 therein. Two rows of terminal passages 13 are formed in upper and bottom walls of the housing 1, and communicate with the trapezoid space 11 and the rectangular space 12.

The terminals 2 are inserted into the terminal passages 13 from the rectangular space 12, with elastic contact portions 21 in the front of the terminals 2 inserted into the trapezoid space 11, and tail portions 22 in the rear to connect with the PCB 3. A plurality of barbs 23 are formed with the middle of each of the terminals 2 to hold the terminal 2 in the housing 1.

The PCB 3 defines upper and lower surfaces, each of the upper and lower surfaces forming a plurality of first conductive traces 31 at the front, a plurality of second conductive traces 32 at the rear, and a plurality of circuit lines 33 to connect the corresponding first and second conductive traces. The space between adjacent first conductive traces 31 is equal to that of adjacent conductive terminals 2 so as to facilitate to solder the terminals 2 to the first conductive traces 31. The space between adjacent second conductive traces 32 is larger so that it is easy to solder the wires 60 to the second conductive traces 32.

In this preferred embodiment, this built-in PCB 3 not only provide general signal transmission, but also is installed some function components, chips on to meet the needs of manufacturers or designers.

The wire management member is composed of upper and lower spacers 41, 42. From top surface of the upper spacer 41 a plurality of convex bars 411 protrude upwards along the wires 60 to form a plurality of slots 410, so as to accept and manage the wires 60. Similarly, a plurality of convex bars 421 protrude downwards along the wires 60 from bottom surface of the lower spacer 42 to form a plurality of slots 420, so as to accept and manage the wires 60.

A pair of locking arms 412 protrude downwards from both sides of bottom surface of the upper spacer 41, and each has an expansion 413 in the front. A pair of grooves 422 are formed at both sides of the lower spacer 42 to interferentially receive the locking arms 412, and each forms a narrow neck 423 to prevent the expansion 413 from withdrawing from the groove 422, so as to fix the upper and lower spacers 41, 42 together. Guide portions 413, 423 are formed to lead the expansions 413 through the narrow necks 423.

In assembly, firstly, arrange the wires 60 in the corresponding slots 410, 420 of the upper and lower spacers 41, 42, with the front end of the wires 60 exposed in front of the slots 410, 420 to facilitate removal of outer insulators 61 of the wires 60. Secondly, Put a dab of glue in each slots 410, 420 to fix the wires 60 in the upper and lower spacers 41, 42. Thirdly, remove the outer insulator 61 of the front end of the wires 60 by Laser Machining to expose inner conductors 62 outside. Fourthly, assemble the upper and lower spacers 41, 42 together, and solder the inner conductors 62 onto the PCB 3.

100221 The metal shell 5 is stamped by a metal sheet and has an elongate base plate 51 with a through hole 510. A box portion 52 enclosed by several sidewalls is formed in the front of the metal shell 5 to receive the insulative housing 1. A pair of side walls 53 extend upwards from both sides of the rear of the base plate 51, and forms a pair of retention portion 531 to engage with a cover shell (not shown) which is used to cover the rear of the metal shell 5. Finally, a casing (not shown) is molded over the rear end of the metal shell 5, the cover shell and the cable 6. In this preferred embodiment, the detail of the cover shell and the casing is not shown, but is similar to corresponding parts of Chinese Patent No. 200420028550.

Note that the slots 410, 420 are formed in outer surfaces of the wire management member, and it is useful to reduce the height of the wire management member. As the wires 60 received in the slots 410, 420 are needed to be soldered to corresponding terminals 2 or conductive traces 32, the space between upper and lower rows of slots 410, 420 is almost changeless, equal to that of adjacent rows of terminals or traces. Therefore, to reduce the height of the wire management member, it is necessary to reduce other dimensions that exclude the space between upper and lower rows of slots 410, 420. It is obvious that the height of the wire management member is minimum, almost equal to the space between upper and lower rows of slots 410, 420, in condition that the slots 410, 420 are formed in outer surfaces of the wire management member. On the other hand, it is easy and convenient to have the upper spacer 41 and the lower spacer 42 respectively assembled with the corresponding upper row wires and lower row wires and successively assembled to each other as the final assembly. It is noted that according to FIG. 1 the rear edge of the printed circuit board 3 confronts a front face of the wire management member 41, 42, and the front end of the insulator 61 of each wire 60 terminates in front of the rear edge of the printed circuit board. A depth of the slot 410 of the upper spacer 41 is offset from the upper surface of the printed circuit board 3, and a depth of the slot 420 of the lower spacer 42 is offset from the second surface of the printed circuit board 3 so as to forgive diameter difference between the insulator 61 and the inner conductor 62. A middle level of the printed circuit board 3 is coplanar with an interface between the upper spacer 41 and the lower spacer 42 where both the upper spacer 41 and the lower spacer 42 are back to back assembled to each other.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing defining a mating port exposed to an exterior in a front-to-back direction;

a printed circuit board located behind the housing and defining opposite first and second surfaces and opposite front and rear regions thereof;

a plurality of wires each including an inner conductor surrounded by an insulator; the inner conductors being soldered upon the rear regions on the first and second surfaces of the printed circuit board;

a wire management member located behind the printed circuit board and defining first and second parts back to back stacked with each other in a vertical direction perpendicular to said front-to-back direction; and each of said first and second parts defining a plurality of slots extending therethrough in said front-to-back direction under condition that in each of said first and second parts, each of said slots is outwardly open to an exterior in the vertical direction away from the other so as to allow the insulator of the corresponding wire to be assembled thereinto in the vertical direction rather than a back-to-front direction opposite to said front-to-back direction; wherein a rear edge of the printed circuit board confronts a front face of the wire management member in said front-to-back direction, and a front end of the insulator of each wire terminates before reaching said rear edge.

2. The cable connector assembly as claimed in claim 1, wherein a depth of the slots of the first part is offset from the first surface of the printed circuit board, and a depth of the slots of the second part is offset from the second surface of the printed circuit board so as to forgive diameter difference between the insulator and the inner conductor.

3. The cable connector assembly as claimed in claim 1, wherein a middle level of said printed circuit board is coplanar with an interface between the first part and the second part where said first part and said second part are back to back assembled to each other.

* * * * *